US007922597B2

(12) United States Patent
Feret

(10) Patent No.: US 7,922,597 B2
(45) **Date of Patent: *Apr. 12, 2011**

(54) GOLF PUTTER HEAD WITH CURVED SOLE

(75) Inventor: Valentine George Feret, Littleton, CO (US)

(73) Assignee: Valentine G. Feret, Jr., Littleton, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/380,265

(22) Filed: Feb. 18, 2009

(65) Prior Publication Data

US 2010/0210372 A1 Aug. 19, 2010

(51) Int. Cl.
*A63B 69/36* (2006.01)
*A63B 53/04* (2006.01)

(52) U.S. Cl. ..... 473/251; 473/256; 473/328; 473/340; 473/341

(58) Field of Classification Search ..... 473/324–350, 473/251–256; D21/736–746
See application file for complete search history.

(56) References Cited

U.S. PATENT DOCUMENTS

| | | | | | |
|---|---|---|---|---|---|
| 786,268 | A * | 4/1905 | Corey | 473/325 |
| 3,064,975 | A * | 11/1962 | Smith | 473/328 |
| 3,387,845 | A * | 6/1968 | Raub | 473/340 |
| D229,204 | S * | 11/1973 | Romero | D21/741 |
| 3,888,484 | A * | 6/1975 | Zitko | 473/252 |
| 4,008,896 | A * | 2/1977 | Gordos | 473/336 |
| 4,138,117 | A * | 2/1979 | Dalton | 473/255 |
| 4,861,038 | A * | 8/1989 | Fucinato | 473/328 |
| 4,962,931 | A * | 10/1990 | Jazdzyk, Jr. | 473/252 |
| 5,072,941 | A * | 12/1991 | Klein | 473/255 |
| 5,494,282 | A * | 2/1996 | Pranio | 473/313 |
| 5,601,499 | A * | 2/1997 | Segaline | 473/313 |
| 5,643,100 | A * | 7/1997 | Zabytko et al. | 473/250 |
| D392,009 | S * | 3/1998 | Maltby | D21/743 |
| 5,795,239 | A * | 8/1998 | Lin | 473/255 |
| 6,406,379 | B1 * | 6/2002 | Christensen | 473/251 |
| 6,702,689 | B2 * | 3/2004 | Ashton | 473/251 |
| 6,863,617 | B2 * | 3/2005 | Park | 473/226 |
| 6,962,537 | B2 * | 11/2005 | Johnson | 473/313 |
| 6,988,959 | B2 * | 1/2006 | Pollman | 473/313 |
| 7,040,999 | B2 * | 5/2006 | Trainello | 473/238 |
| 7,156,753 | B2 * | 1/2007 | Casner et al. | 473/340 |
| 7,419,439 | B1 * | 9/2008 | Aleamoni | 473/251 |
| D616,513 | S * | 5/2010 | Feret | D21/743 |
| 2006/0068935 | A1 * | 3/2006 | Tang et al. | 473/340 |
| 2006/0166755 | A1 * | 7/2006 | Brown | 473/251 |

* cited by examiner

*Primary Examiner* — Sebastiano Passaniti

(57) ABSTRACT

A golf putter generally has a nearly flat sole surface, multiple or decorative sight lines used to align the putter with the target, or target line. This new design has an extremely rounded sole surface from heel to toe and from the ball striking face to the rear of the putter head. This works extremely well when putting through taller fringe grasses off the green. The well rounded heel and toe and leading angular surface contribute to stabilizing the orientation of the ball striking face when putting from extremely sloped side hill lies in the taller fringe grasses. It has a single brightly colored sight line from the ball striking face to the rear of the putter head to eliminate a majority of visual clutter. This focuses the golfers eyes completely on the sight line, target line, and center of the golf ball.

1 Claim, 5 Drawing Sheets

GOLF PUTTER HEAD WITH CURVED SOLE

BACKGROUND OF THE INVENTION

This invention is related to the golfing industry. The putter is designed to be used not only on the putting green, but off the putting surface in the taller fringe grasses. The extremely rounded sole surface and weight distribution are formed to enhance a golfers ability to stroke the putter with a solid feel and consistent alignment. This rounded sole surface, the shorter heel to toe ball striking face and taller ball striking face all contribute with moving the putter head easily through the taller fringe grasses around the perimeter of a green. This configuration also benefits the golfer on side hill lies by limiting or even avoiding heel or toe contact which keeps the ball striking face orientation in the desired direction. Putting through the taller fringe grasses with the taller ball striking face of this club helps to avoid a double contact with the ball when the swing arc is to low. Putters with a lower ball striking face have a tendency to strike the ball on the top front edge of the club which lifts the ball into the air and into the forward swing arc a second time.

BRIEF SUMMARY OF THE INVENTION

This invention of a golfing putter is of a smaller, compact, and versatile putter head design. It is designed to satisfy the needs of golfers of all abilities on and near the putting surface. The uninterrupted, wide and long, bright white sight line groove against the dark colored putter head extends the travel line which a golf ball will be moving from the target to the middle of the golfers stance. More importantly, it accurately centers the golf ball with the putters sweet spot. The extremely rounded sole surface from heel to toe, and front to rear, and leading angular surface assists the golfer through a consistent swing arc, preventing the front edge from digging into the putting surface and the rear of the sole surface from bouncing as many elongated, flatter sole surface putters tend to do. The wide and elongated main weight, centered on the sight line will give the golfer a solid feeling when the golf ball is struck. The extra width of the main center weight also increases the area of the sweet spot. The shaft connected to the putter head will be of various lengths to accommodate the different heights of men and women golfers. The grip on the shaft will have a flat surface positioned perpendicular to the ball striking face and, parallel to the sight line groove, to help insure proper alignment. The grip will vary in materials used and will enhance the golfers sense of touch. The variation will come from the soft, medium, or firm feeling of these materials.

DETAILED DESCRIPTION OF THE INVENTION

Figure 1:
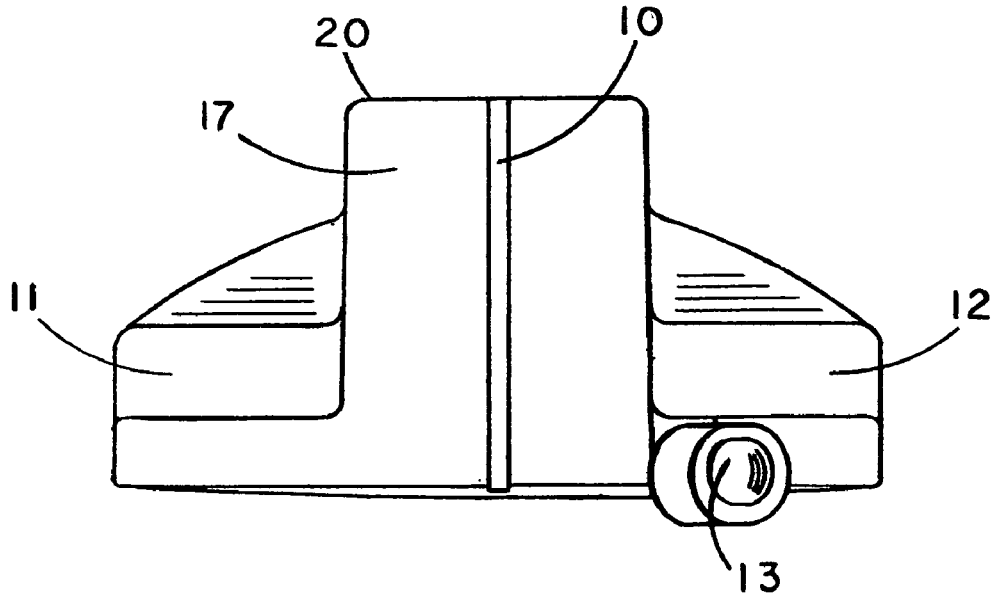
FIG. 1 is the top view of the putter head.
Figure 2:
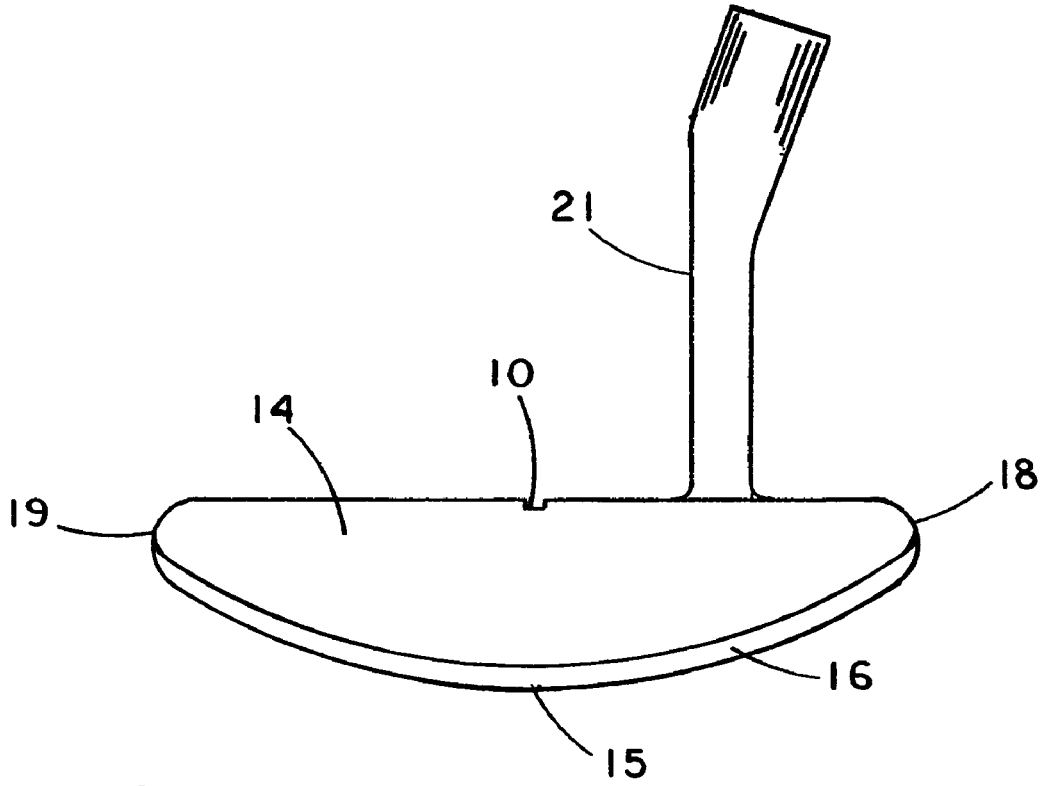
FIG. 2 is the front view of the putter head.

With reference to the (FIG. 1),the putter head is a one piece construction which can be manufactured from a number of metallic materials. It can be constructed from aluminum, carbon steel, stainless steel, brass, or other alloys. Alternating the materials will change the final construction weight from a light to a heavy feel, thus satisfying many golfers swing weight and feeling needs. Touch and feel are a major part of accurate putting. The putter may be manufactured by castings, forging, and or a machining process. The body of the putter is a satin black in color with the exceptions of the sight line groove 10 (FIG. 1) and the ball striking face 14 (FIG. 2). This background color will nearly eliminate the golfers visual clutter in order to improve his or her playing ability. The sight line groove 10 (FIG. 1) is a single groove about 0.09 inch to 0.12 inch wide and 0.03 inch deep running perpendicular from the ball striking face 14 (FIG. 3) to the rear surface 20 (FIG. 3) of the putter head. This groove can be filled in with a white iridescent paint or a bright white epoxy. This bright color is used to capture a major portion of a golfers vision when lining up the center of the golf ball with the target, being the hole or target line on which the ball is intended to travel. The toe weight 11 (FIG. 1) and the heel weight 12 (FIG. 1) are designed to assist the main center weight 17 (FIG. 1) with preventing a rotating motion of the putter when the golf ball is struck off center of the sweet spot. In addition the main center weight 17 (FIG. 1) having a width of about 1.62 inches may be elongated from about 1.88 inches to 2.50 inches in order to change the overall weighting of the putter head, to minimize a rotating motion of the putter head when striking the golf ball off center, and increasing the overall swing weight of the club for a better feel.

The shaft insertion hole 13 (FIG. 1) from which a shaft made of steel, graphite or other suitable materials will be connected with an adhesive or by other means to the putter head. The shaft will vary in length to accommodate the golfers height differences. Attached to the shaft will be a grip. The grip will be made up of leather, rubber or other suitable materials. It will have an alignment flat which when assembled to the putter's shaft and the putter's head, will be positioned perpendicular to the ball striking face 14 (FIG. 2) and parallel to the sight line groove 10 (FIG. 1) to further assist with the proper alignment of the putter to the target or target line. The putter shaft and grip not shown are to be commercially purchased. This in turn will not limit the golfer to a specific shaft material or grip manufacturer. The ball striking face 14 (FIG. 2) is presently smooth and may be enhanced with a variety of configurations of grooves to maximize the rotation of a golf ball when first struck. The ball striking face 14 (FIG. 3) also has a slight loft angle, again to enhance the ball rotation when first struck. The sooner the ball starts to rotate the more it tends to hold the directional line on which it is intended to travel. The higher ball striking face 14(FIG. 4) of about 1.00 inch to 1.12 inches tall eliminates the possibility of double striking the golf ball when putting through tall fringe grasses of 1.00 inch or higher. Double striking the ball does occur when the swing arc is to low through the taller fringe grasses, when using a putter with a lower ball striking face profile. The extremely rounded sole surface 15 (FIG. 2) with a radius of about 3.38 inches from it's rounded heel 18 (FIG. 2) to it's rounded toe 19 (FIG. 2) is designed to minimize contact with the putting greens surface. To minimize resistance while putting from off the green through the taller fringe grasses. To nearly eliminate the heel 18 (FIG. 2) or toe 19 (FIG. 2) from contacting the turf on side hill lies while putting from off the green.

Figure 3:
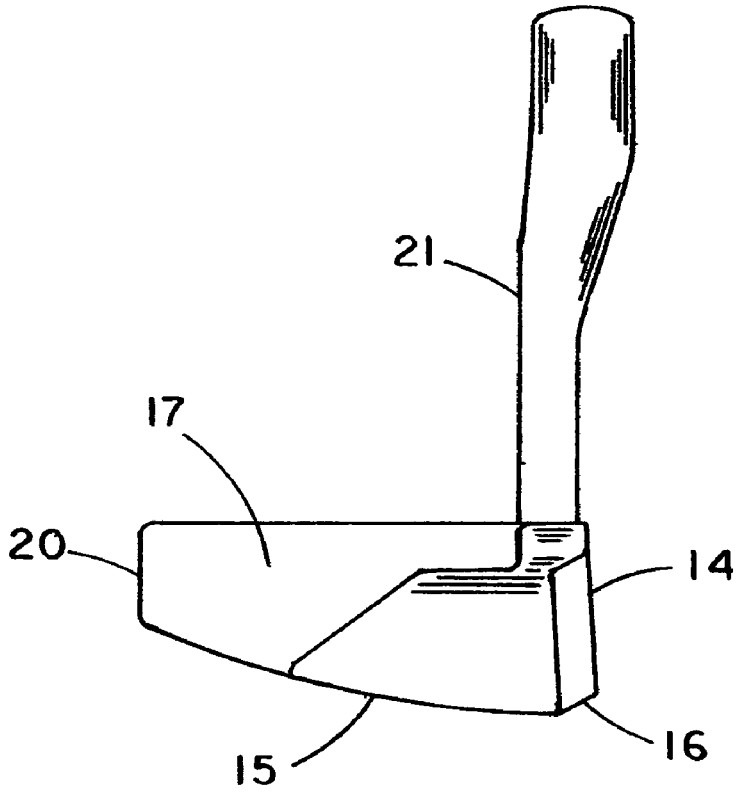
FIG. 3 is the toe view of the putter head.
Figure 4:
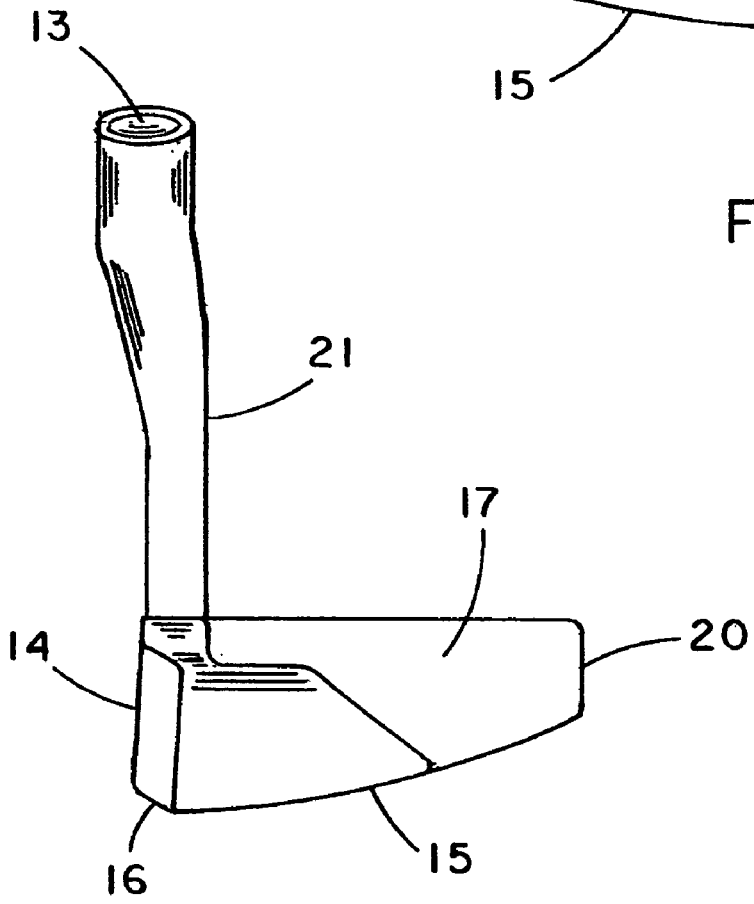
FIG. 4 is the heel view of the putter head.
Figure 5:
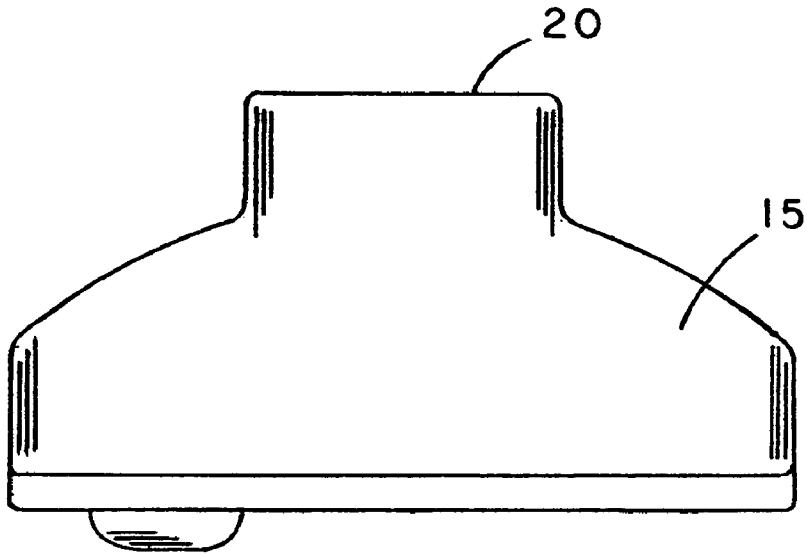
FIG. 5 is the bottom view of the putter head.
Figure 6:
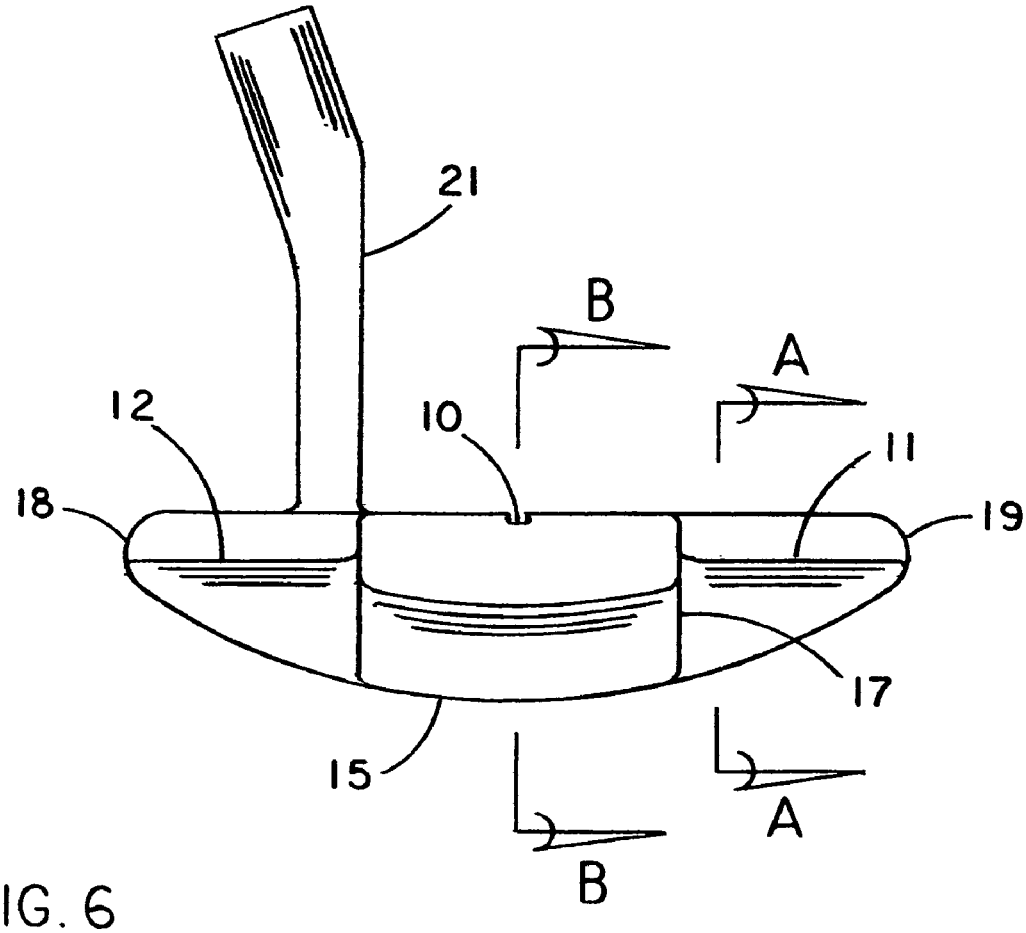
FIG. 6 is the rear view of the putter head.

This reduces the possibility of the putter head rotating from the desired orientation of the ball striking face 14 (FIG. 2). The distance from the rounded heel 18 (FIG. 2) to the rounded toe 19 (FIG. 2) is to be a maximum of 4.00 inches in overall length to minimize contact with the taller fringe grasses. The extremely rounded sole surface 15 (FIG. 3) with a radius of about 5.12 inches from the ball striking face 14 (FIG. 3) to the rear surface 20 (FIG. 3) eliminates the possibility of the rear sole surface 15 (FIG. 3) from bouncing while going through a consistent swing arc. A consistent swing arc is that motion like the swing of a clock pendulum. Unlike the flatter, elongated putters that will tend to bounce off the putting surface while going through a consistent swing arc. The leading 30 degree from horizontal angular surface 16 (FIG. 3) with a radius at each end will eliminate a sharp corner between the ball striking face 14 (FIG. 3) and the sole surface 15 (FIG. 3). This prevents the putter head from digging into the surface of the putting green during the forward stroke, which can cause the putter head to momentarily bounce giving the club head an opportunity to double strike the golf ball. The main center weight 17 (FIG. 1) is about 1.62 inches wide, elongated and centered on the sight line groove 10 (FIG. 1). This is to obtain the majority of the putters weight directly behind the ball striking area, and increases the area of the sweet spot. The main center weight 17 (FIG. 1) because of it's extra width and length increases the putters moment of inertia, stability, improves balance and feel, and provides a true roll when striking the golf ball. To make this putter design available to all golfers a left handed version can be manufactured by using the mirror image of the right handed putter shown in (FIG. 1) through (FIG. 6).

Figure 7:
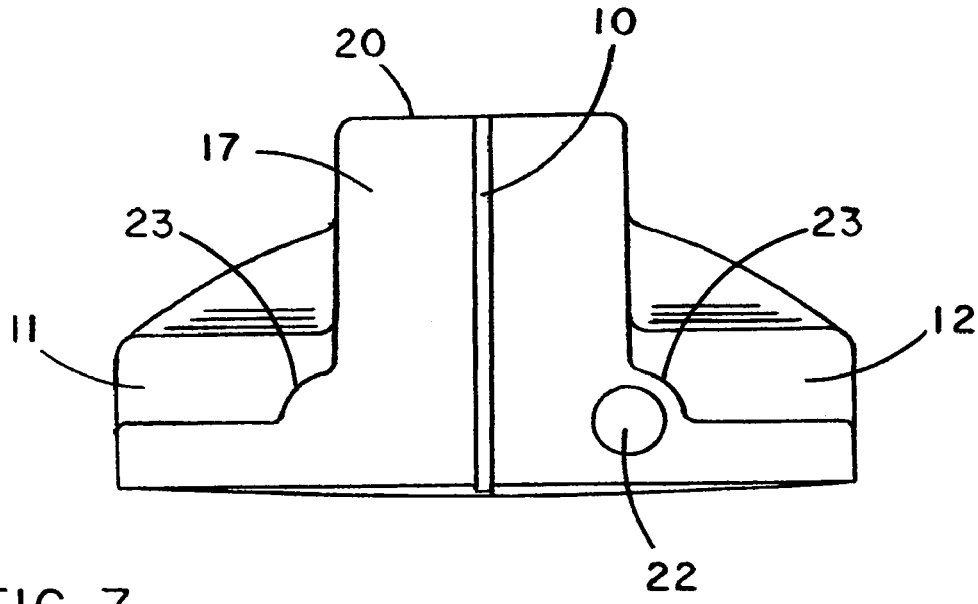
FIG. 7 is the top view of the putter head with a design modification.
Figure 8:
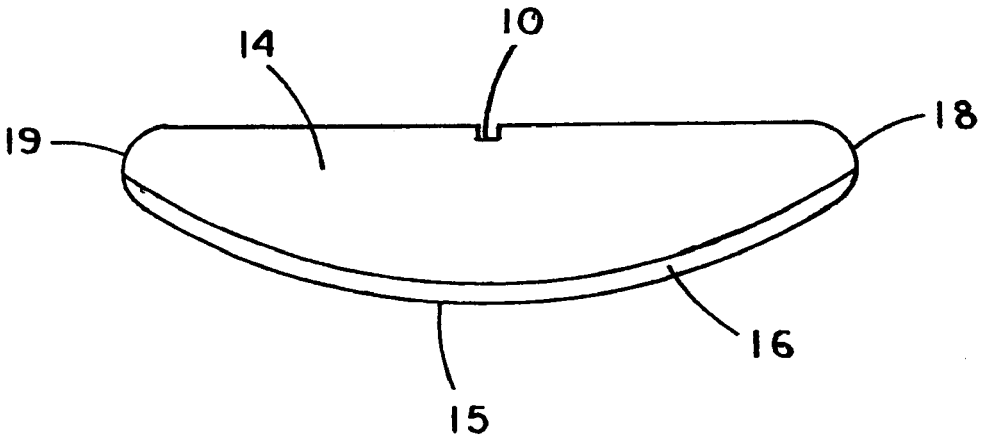
FIG. 8 is the front view of the putter head with a design modification.
Figure 9:
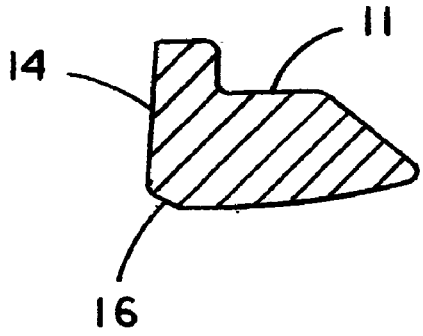
FIG. 9 is the cross-sectional view through A-A of FIG. 6 showing the toe weight profile.
Figure 10:
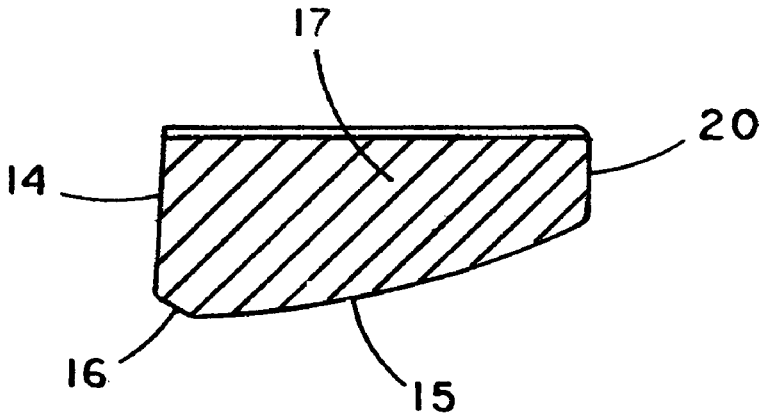
FIG. 10 is the cross-sectional view through B-B of FIG. 6 showing the main center weight profile.

To further enhance the putters performance and streamline it's appearance the heel weight 12 (FIG. 6) and the toe weight 11 (FIG. 6) are extended to intersect with the main center weight 17 (FIG. 6) In doing so, more mass is added behind the ball striking surface increasing the area of the sweet spot. Prior design features of the putter head described and shown in (FIG. 1) through (FIG. 6) along with (FIG. 9) and (FIG. 10) have the same functions as the modified design shown in (FIG. 7) and (FIG. 8). The removal of the shaft connection stem 21 (FIG. 1) the addition of a boss 23 (FIG. 7) on either side of the sight line groove 10 (FIG. 7) and the shaft insertion hole 22 (FIG. 7) is to accommodate the golfer who prefers to use a putter with a single bend or a double bend shaft attached directly to the putter's head. A left handed version can be manufactured by machining the shaft insertion hole 22 (FIG. 7) on the opposite side of the sight line groove 10 (FIG. 7), and using a left handed double bend shaft.

The invention claimed is:

1. A golf putter head comprising:

a front ball striking face, a rounded toe end, a rounded heel end, a sole surface, a top surface and a rear surface; said ball striking face including a leading edge at the intersection of the ball striking face and the sole surface; said ball striking face having a height of between about 1.00 inch to 1.12 inches; the leading edge being angled 30 degrees with respect to a horizontal plane upon which the sole surface may rest; said putter head including a horizontal dimension less than 4.00 inches as measured from said rounded heel end to said rounded toe end;

a main center weight, a heel weight and a toe weight; said heel weight extending from said rounded heel end inwardly toward the main center weight; said toe weight extending from said rounded toe end inwardly toward the main center weight; said main center weight extending rearwardly from adjacent said ball striking face toward said rear surface and forming a portion of both said top surface and said rear surface; the main center weight having a width in the heel-to-toe direction of about 1.62 inches and a length in the front-to-rear direction of between about 1.88 inches to 2.50 inches;

said sole surface including a substantially continuous concave curvature extending from said rounded heel end toward said rounded toe end as seen from a front view; the radius of said curvature being about 3.38 inches in the heel-to-toe direction; said sole surface further including a rounded sole surface extending from said ball striking face toward said rear surface; the radius of said rounded sole surface being about 5.12 inches in the front-to-rear direction as measured along a vertical plane extending through the main center weight and perpendicular to the plane of the ball striking face;

a sight line groove formed in said top surface and extending from adjacent said ball striking face to adjacent said rear surface and oriented perpendicular to the plane of the ball striking face; the width of said main center weight being centered about said sight line groove;

a shaft insertion hole formed in the top surface of said putter head for accepting a shaft and grip assembly.

* * * * *